United States Patent [19]

Graczyk et al.

[11] Patent Number: 4,766,731

[45] Date of Patent: Aug. 30, 1988

[54] METHOD TO DELIVER ULTRA HIGH PURITY HELIUM GAS TO A USE POINT

[75] Inventors: Lawrence S. Graczyk, Orchard Park; Arthur W. Francis, Sr., New City, both of N.Y.

[73] Assignee: Union Carbide Corporation, Danbury, Conn.

[21] Appl. No.: 91,888

[22] Filed: Sep. 1, 1987

[51] Int. Cl.[4] ..... F17C 7/02

[52] U.S. Cl. ..... 62/55; 62/514 R

[58] Field of Search ..... 62/514 R, 55

[56] References Cited

U.S. PATENT DOCUMENTS

| | | | |
|---|---|---|---|
| 2,158,458 | 5/1939 | Mathis et al. | 219/33 |
| 2,242,108 | 5/1941 | Bullowa et al. | 128/191 |
| 2,842,942 | 7/1958 | Johnston et al. | 62/50 |
| 2,895,303 | 7/1959 | Streeter | 62/12 |
| 3,366,107 | 1/1968 | Frantom | 128/142.2 |
| 3,415,069 | 12/1968 | Hauser | 62/40 |
| 3,473,343 | 10/1969 | Chamberlain | 62/45 |
| 3,653,220 | 4/1972 | Foster et al. | 62/22 |
| 3,683,589 | 8/1972 | Seitz et al. | 55/62 |
| 3,719,053 | 3/1973 | DeMarco et al. | 62/38 |
| 3,792,591 | 2/1974 | Collins | 62/40 |
| 3,827,246 | 8/1974 | Moen et al. | 62/50 |
| 4,072,024 | 2/1978 | Higgins | 62/50 |
| 4,444,572 | 4/1984 | Avon et al. | 55/26 |
| 4,579,566 | 4/1986 | Brugerolle | 55/50 |
| 4,607,489 | 8/1986 | Krongold | 62/49 |

*Primary Examiner*—Ronald C. Capossela

*Attorney, Agent, or Firm*—Stanley Ktorides

[57] ABSTRACT

A method to deliver ultra high purity helium gas to a use point without need for further pressurization of helium gas after it is warmed or vaporized, wherein gaseous helium, having a purity which can be less than that of the product, is passed in heat exchange relation with cold helium to warm or vaporize and thus pressurize the helium while simultaneously being cleaned of impurities, and the resulting helium gas from both sources is delivered as ultra high purity helium gas to the use point.

31 Claims, 1 Drawing Sheet

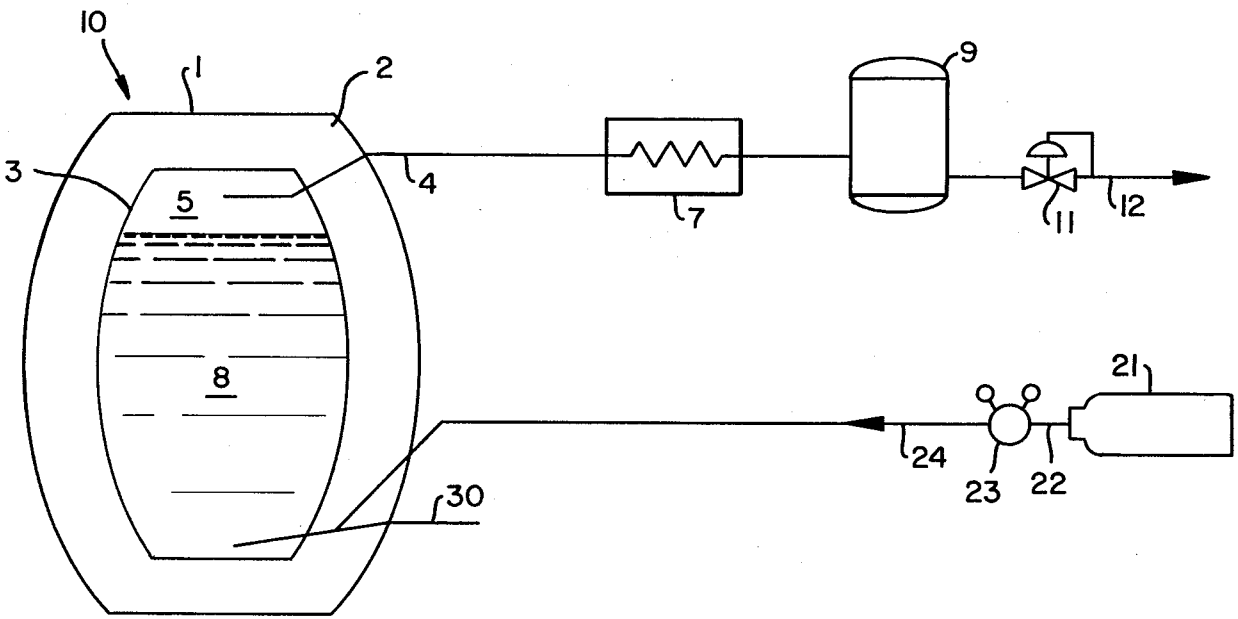
10
1
2
3
4
5
7
8
9
11
12
21
22
23
24
30

METHOD TO DELIVER ULTRA HIGH PURITY HELIUM GAS TO A USE POINT

TECHNICAL FIELD

This invention relates generally to the delivery of helium gas to a use point and, in particular, is an improvement wherein such helium gas is delivered at unexpectedly high purity.

BACKGROUND ART

When relatively large quantities of gases, such as oxygen, nitrogen, argon or hydrogen, are required by a use point, the gases are generally delivered in liquid form to a storage tank near the use point. The liquefied gas is then vaporized and passed on as needed to the use point.

The gas must be delivered to the use point at a pressure specified by the use point requirements. However, for safety reasons, liquefied gases cannot be transported over public roads from a production plant to the liquid storage tank near the use point at pressures significantly above atmospheric. For most gases the use point pressure requirement is met by pumping the liquefied gas from the transport vehicle into the storage tank using a liquid pump to increase its pressure. The liquefied gas is stored in the storage tank at this high pressure and, upon demand from the use point, is vaporized at the high pressure and delivered to the use point as pressurized gas meeting the use point pressure requirements.

This pressurizing procedure may be used effectively with all liquefied gases except for helium. Because of its unusual physical properties, it is not practical to pump liquid helium to a significantly higher pressure. Because of the very low heat of vaporization of liquid helium, the heat introduced to the liquid by the action of the liquid pump causes a significant amount of the liquid to be vaporized and thus lost. Furthermore, because the density of cold helium gas is not much different from that of liquid helium, every time a storage tank is filled with liquid helium, a large amount of the cold helium gas within the tank is displaced and lost; at higher pressures these displacement losses are even higher. Accordingly, heretofore, helium has been delivered to use points by cylinder or tube trailer as high pressure gas.

While this helium delivery system is satisfactory for most uses of helium, it presents a problem when the use point requires gaseous helium of ultra high purity. This is because the pumping activity required to achieve the requisite pressure invariably causes some impurity contamination of the gaseous helium. Heretofore the highest purity gaseous helium generally available has had an impurity concentration of about 30 to 50 parts per million (ppm). Ultra high purity helium gas is being increasingly required by, for example, the electronics industry.

Therefore, it is an object of this invention to provide a method to deliver efficiently ultra high purity helium gas to a use point at the use point pressure requirement.

SUMMARY OF THE INVENTION

The above and other objects which will become apparent to one skilled in the art upon a reading of this disclosure are attained by:

A method to deliver helium gas to a use point comprising:

(A) providing gaseous helium into a storage container containing cold helium;

(B) passing the gaseous helium in heat exchange relation with said cold helium to:

(i) warm cold helium, (ii) increase or maintain the helium pressure, and (iii) condense and/or solidify impurities out of the gaseous helium;

(C) withdrawing ultra high purity helium gas comprising resulting warmed helium and cleaned gaseous helium from the storage container; and (D) providing ultra high purity helium gas to a use point without need for further pressurization, said helium gas containing less than 10 ppm impurities.

As used herein the term "cold helium" means liquid helium or helium as a supercritical fluid at a temperature less than 20 degrees Kelvin (K.).

As used herein the term "supercritical fluid" means a fluid at or above its critical temperature and pressure. The critical temperature of helium is 5.2 K. and the critical pressure of helium is 33.2 pounds per square inch absolute (psia).

As used herein, the term "direct heat exchange" means the bringing of two fluids into heat exchange relation with physical contact, or intermixing of the fluids with each other.

As used herein, the term "indirect heat exchange" means the bringing of two fluids into heat exchange relation without any physical contact or intermixing of the fluids with each other.

BRIEF DESCRIPTION OF THE DRAWING

The sole FIGURE is a schematic diagram of one preferred arrangement useful for carrying out the method of this invention.

DETAILED DESCRIPTION

The invention will be described in detail with reference to the Drawing which illustrates one situation where the cold helium is liquid helium and the heat exchange is direct heat exchange.

Referring now to the FIGURE, storage container 10 is a double-walled vessel having outer wall 1 and inner wall 3 with the space between the walls filled with insulation 2 such as multi-shielded vacuum insulation. Container 10 contains a quantity of liquid helium 8 within the volume defined by inner wall 3.

Gaseous helium is provided into container 10 and into heat exchange relation with liquid helium 8. The gaseous helium could be from any suitable source. A convenient source of gas is a high pressure cylinder or tube, such as is shown in the FIGURE as tube 21, which contains gaseous helium at high pressure. Conveniently a number of such tubes could be manifolded together.

High pressure gaseous helium 22 from source 21 is passed through pressure reducing regulator 23 and its pressure reduced, preferably to about 20 to 25 pounds per square inch (psi) greater than the use point pressure requirement. The resulting gaseous helium 24 is then passed into container 10 and in heat exchange relation with liquid helium 8. Conveniently gaseous helium 24 may be passed into container 10 through liquid fill pipe 30. Gaseous helium may be passed into the helium container continuously or intermittently.

The heat exchange between the gaseous helium and the liquid helium may be direct or indirect. For example, the gaseous helium could pass through one or more pipes or coils within the volume of liquid helium and thus serve to indirectly warm the liquid helium. Preferably the qaseous helium contacts the liquid helium, such as by being injected or sparged into and bubbled through the liquid helium, so as to directly warm the liquid helium. This direct heat exchange embodiment is illustrated in the FIGURE.

Referring back now to the FIGURE, gaseous helium 24 bubbles up through liquid helium 8 and in the process three things happen simultaneously. First, heat from the gaseous helium is transferred to the liquid helium causing some of the liquid helium to vaporize. Second, the pressure of the helium, i.e., the pressure within the container, is either increased or, if helium gas is being withdrawn, maintained, both because of the introduction of pressurized gaseous helium into the container and because of the vaporization of some of the liquid helium by the aforementioned direct heat transfer. Third, impurities within the gaseous helium are condensed and/or solidified out of the gaseous helium.

It is an advantage of this invention that, although the product is ultra high purity helium gas, the gaseous helium used for pressurization and vaporization need not be of such a purity level. Indeed the gaseous helium may have an impurity concentration up to about 100 times that of the ultra high purity helium gas product. Among the impurities which may be present in the gaseous helium one can name nitrogen, oxygen, argon, neon, carbon dioxide, water, hydrogen and hydrocarbons. The gaseous helium may be provided into the container at any convenient temperature although ambient temperature is the most convenient and is preferred. Because the condensation temperature of helium is lower than that of all of the impurities, the cooling of the gaseous helium by the aforementioned direct or indirect heat transfer causes the impurities to condense and/or solidify out of the gaseous helium. As used here, the term "impurities" means both a single specie and more than one specie of impurity.

The freezing point of oxygen is 54.4 K., that of neon is 24.6 K. and that of hydrogen is 14.0 K. Accordingly the gaseous helium should remain in heat exchange relation with the cold helium for a period of time sufficient to be cooled to a temperature of 54.4 K., preferably to a temperature of 24.6 K., most preferably to a temperature of 14.0 K. This requisite residence time will vary and will depend on factors known to those skilled in the art such as the size of the helium gas bubbles, if helium gas is passed into liquid helium, and the length and diameter of the heat exchange coil, if gaseous helium is piped through the cold helium. In any event, it is important to the practice of this invention that sufficient cold helium be maintained in the container to ensure that the gaseous helium is cooled to the point where impurities are condensed and/or solidified out of the helium. Requisite cold helium is maintained in the container when it is sufficient to cool the gaseous helium to a temperature of 54.4 K. or less, preferably 24.6 K. or less, most preferably 14.0 K. or less.

Referring back to the FIGURE, helium gas 5 collects above the level of liquid helium 8. Helium gas 5 comprises vaporized helium which was originally liquid helium 8, and gaseous helium which was substantially cleaned of impurities as it bubbled up through the liquid helium. In the case where gaseous helium indirectly warms the cold helium, the heat exchange conduit could discharge the helium gas into the container at or near the top of the container or directly into a withdrawal line such as line 4.

It is important to note that the description of the invention with respect to liquid helium applies at system pressures less than the critical pressure of helium (33.2 psia). For higher system pressures, the material within the storage vessel is a supercritical fluid and there is no distinction between the gas and liquid phases. In this case the heat exchange between the gaseous helium and the supercritical helium fluid serves to warm, but not vaporize, the supercritical helium fluid. In addition the introduction of the gaseous helium serves to expel material from the top of the vessel, and the cooling of the gaseous helium serves to remove impurities from the gaseous helium. Since the impurities will solidify, they will settle to the bottom of the storage vessel and will not flow out with the product helium gas.

When supercritical helium fluid is employed as the cold helium, it is important that the temperature of the supercritical helium fluid be less than 20 K. Otherwise sufficient heat exchange to achieve the desired product may not be carried out.

Typically, the cold helium employed at the initiation of the process of this invention is liquid helium. Thereafter, depending on system pressures, the pressure within the system may increase to the point where the cold helium becomes supercritical helium fluid. When the cold helium is liquid helium, the heat exchange with the gaseous helium serves to warm and vaporize liquid helium. When the cold helium is supercritical helium fluid, the heat exchange serves to harm the supercritical helium fluid. In both situations, however, the heat exchange serves to increase or maintain the helium pressure and to condense and/or solidify impurities out of the gaseous helium.

Referring back to the FIGURE, ultra high purity helium gas 5 is withdrawn from container 10 through line 4 generally at a point above the point where the gaseous helium was introduced into the container, and is provided to use point 12 without need for further pressurization. It is an important aspect of this invention that helium gas may be delivered to the use point not only at ultra high purity but also without need for further pressurization after vaporization. The ultra high purity helium of this invention has an impurity concentration of less than 10 ppm and may have an impurity concentration less than 5 or even 2 ppm.

The FIGURE illustrates three options which may be employed in the delivery of ultra high purity helium gas to the use point. The options may be used individually or in any combination. The ultra high purity helium gas may be warmed, such as by passage through atmospheric vaporizer 7, stored in storage tank 9, or have its pressure reduced by passage through pressure reducing valve 11.

Gaseous helium may be passed into container 10 at any suitable flowrate consistent with achieving good heat transfer within the container. Factors that will influence the quality of the heat transfer are the shape of the container, the amount of liquid within the container when the cold helium is liquid helium, and the required use point pressure. One way to improve the heat transfer is to increase the gaseous helium pathway through the cold helium such as by utilizing horizontal baffles within the container between the gaseous helium entry point and the helium gas withdrawal point.

When liquid helium is used as the cold helium and in order to maintain sufficient heat transfer opportunity and to ensure sufficient purification of the gaseous helium, the amount of liquid helium within the container should not fall below about one-tenth of the liquid capacity of the container. Liquid helium may be passed into the container through fill pipe 30 to replenish the supply.

It is an important aspect of this invention that the gaseous helium, whose primary purposes are to warm the cold helium and to increase or maintain pressure within the container and the system in general, also forms a part of the ultra high purity helium gas product. This serves to increase the overall efficiency of the delivery system.

It is a serendipitous occurrence that gaseous helium may be effectively employed to warm or vaporize cold helium and thus provide sufficient pressurization to the system to enable product delivery to a use point without need for further pressurization. The number of pounds of liquid vaporized by the heat removed from one pound of gas cooled from 70° F. to the normal boiling temperature of that gas for a number of gases is listed in Table I.

TABLE I

| Gas | Pounds |
|---|---|
| Helium | 74.8 |
| Hydrogen | 9.15 |
| Neon | 3.2 |
| Nitrogen | 1.13 |
| Oxygen | 0.88 |
| Argon | 0.67 |

It is thus seen that virtually all other gases could not be practically employed in the invention and that the advantageous results obtained by the invention through the use of certain particular physical properties of helium are unexpected based on the behavior of other cryogenic gases.

Heretofore, it has not been possible to deliver ultra high purity helium gas to a use point at pressure since the pressurization activity inevitably compromised the purity of the delivered product. Now by the use of the present invention one can effectively and efficiently provide helium gas to the use point without need for further pressurization after warming or vaporization while retaining the ultra high purity of the helium gas as it is delivered to a use point.

Although the delivery method of this invention has been described in detail with reference to certain embodiments, those skilled in the art will recognize that there are other embodiments of the invention within the spirit and scope of the claims.

We claim:

1. A method to deliver helium gas to a use point comprising:

(A) providing gaseous helium from a high pressure cylinder or tube into a storage container containing liquid helium;

(B) passing the gaseous helium in heat exchange relation with said liquid helium to:

(i) vaporize liquid helium, (ii) increase or maintain the helium pressure, and (iii) condense and/or solidify impurities out of the gaseous helium;

(C) withdrawing ultra high purity helium gas comprising resulting vaporized helium and cleaned gaseous helium from the storage container; and (D) providing ultra high purity helium gas to a use point without need for further pressurization, said helium gas containing less than 10 ppm impurities.

2. The method of claim 1 wherein said heat exchange is direct.

3. The method of claim 1 wherein said heat exchange relation is indirect.

4. The method of claim 1 wherein said gaseous helium is cooled by the heat exchange to a temperature of 54.4 K. or less.

5. The method of claim 1 wherein the gaseous helium is cooled by the heat exchange to a temperature of 24.6 K. or less.

6. The method of claim 1 wherein the gaseous helium is cooled by the heat exchange to a temperature of 14.0 K. or less.

7. The method of claim 1 wherein the ultra high purity helium gas contains less than 5 ppm impurities.

8. The method of claim 1 wherein the ultra high purity helium gas contains less than 2 ppm impurities.

9. The method of claim 1 wherein the gaseous helium is provided into the storage container continuously.

10. The method of claim 1 wherein the gaseous helium is provided into the storage container intermittently.

11. The method of claim 1 wherein the gaseous helium is provided into the storage container at a pressure about 20 to 25 pounds per square inch higher than the pressure required by the use point.

12. The method of claim 1 wherein the gaseous helium is provided into the storage container having an impurity concentration up to 100 times that of the ultra high purity helium gas.

13. The method of claim 2 wherein the pathway over which the gaseous helium passes in contact with liquid helium is elongated by at least one horizontally oriented baffle between the gaseous helium entry point and the helium gas withdrawal point.

14. The method of claim 1 wherein the ultra high purity helium gas is warmed after withdrawal from the storage container and before provision to the use point.

15. The method of claim 1 wherein the gaseous helium is provided into the storage container at a temperature of about ambient.

16. The method of claim 1 wherein the amount of liquid helium within the container is maintained at not less than one-tenth of the liquid capacity of the container.

17. A method to deliver helium gas to a use point comprising:

(A) providing gaseous helium from a high pressure cylinder or tube into a storage container containing supercritical helium at a temperature less than 20° Kelvin;

(B) passing the gaseous helium in heat exchange relation with said supercritical helium to:

(i) warm supercritical helium, (ii) increase or maintain the helium pressure, and (iii) condense and/or solidify impurities out of the gaseous helium;

(C) withdrawing ultra high purity helium gas comprising resulting warmed helium and cleaned gaseous helium from the storage container; and (D) providing ultra high purity helium gas to a use point without need for further pressurization, said helium gas containing less than 10 ppm impurities.

18. The method of claim 17 wherein said heat exchange is direct.

19. The method of claim 17 wherein said heat exchange relation is indirect.

20. The method of claim 17 wherein said gaseous helium is cooled by the heat exchange to a temperature of 54.4° K. or less.

21. The method of claim 17 wherein the gaseous helium is cooled by the heat exchange to a temperature of 24.6° K. or less.

22. The method of claim 17 wherein the gaseous helium is cooled by the heat exchange to a temperature of 14.0° K. or less.

23. The method of claim 17 wherein the ultra high purity helium gas contains less than 5 ppm impurities.

24. The method of claim 17 wherein the ultra high purity helium gas contains less than 2 ppm impurities.

25. The method of claim 17 wherein the gaseous helium is provided into the storage container continuously.

26. The method of claim 17 wherein the gaseous helium is provided into the storage container intermittently.

27. The method of claim 17 wherein the gaseous helium is provided into the storage container at a pressure about 20 to 25 pounds per square inch higher than the pressure required by the use point.

28. The method of claim 17 wherein the gaseous helium is provided into the storage container having an impurity concentration up to 100 times that of the ultra high purity helium gas.

29. The method of claim 18 wherein the pathway over which the gaseous helium passes in contact with the supercritical helium is elongated by at least one horizontally oriented baffle between the gaseous helium entry point and the helium gas withdrawal point.

30. The method of claim 17 wherein the ultra high purity helium gas is warmed after withdrawal from the storage container and before provision to the use point.

31. The method of claim 17 wherein the gaseous helium is provided into the storage container at a temperature of about ambient.

* * * * *

UNITED STATES PATENT AND TRADEMARK OFFICE

CERTIFICATE OF CORRECTION

PATENT NO. : 4,766,731

DATED : August 30, 1988

INVENTOR(S) : L.S. Graczyk et al

It is certified that error appears in the above-identified patent and that said Letters Patent is hereby corrected as shown below:

In column 4, line 29 delete "harm" and insert therefor --warm--.

Signed and Sealed this

Twentieth Day of December, 198

*Attest:*

DONALD J. QUIGG

*Attesting Officer*

*Commissioner of Patents and Trademarks*